United States Patent [19]

Patel et al.

[11] 4,057,402

[45] Nov. 8, 1977

[54] COAL PRETREATMENT AND GASIFICATION PROCESS

[75] Inventors: Jitendra G. Patel, Bolingbrook; Frank C. Schora, Palatine; John W. Loeding, Naperville, all of Ill.

[73] Assignee: Institute of Gas Technology, Chicago, Ill.

[21] Appl. No.: 700,536

[22] Filed: June 28, 1976

[51] Int. Cl.[2] ..... C10J 3/16

[52] U.S. Cl. ..... 48/197 R; 48/202; 48/206; 110/28 J; 122/5; 201/9; 201/31

[58] Field of Search ..... 48/197 R, 202, 206, 48/210, DIG. 1; 201/9, 15, 29, 31, 36, 37, 38; 252/373; 110/28 J, 31; 122/5

[56] References Cited

U.S. PATENT DOCUMENTS

| | | | |
|---|---|---|---|
| 2,623,815 | 12/1952 | Roetheli | 48/202 |
| 3,884,649 | 5/1975 | Matthews | 48/206 |

*Primary Examiner*—Robert L. Lindsay, Jr.
*Assistant Examiner*—George C. Yeung
*Attorney, Agent, or Firm*—Allegretti, Newitt, Witcoff & McAndrews

[57] ABSTRACT

A process for converting a finely divided carbonaceous material, particularly coal, to a fuel gas. A finely divided or pulverized carbonaceous feed material, such as coal, is pretreated at a temperature of about 700° - 800° F in order to destroy the caking properties of a caking coal feed in a fluidized pretreatment zone, or, alternatively to dry a non-caking coal feed. The pretreated coal is passed from a pretreatment zone to a gasification zone wherein the carbonaceous feed material or coal is maintained as a fluid bed at selected conditions for converting the pretreated material to ash and a gaseous mixture. During the pretreatment of the feed material, hot off gases are formed and the hot off gases, which generally comprise steam, tars, oils, and carbonaceous fines, are passed from the pretreatment zone to the underside of the fluid bed in the gasification zone. The steam contained in the off gases is reacted with the coal in the fluidized bed in the gasification zone for converting the coal feed material to ash and the fuel gas product. The off gases also provide heat for maintaining the desired temperature conditions in the gasification zone. The tars and oils in the off gases are substantially destroyed during passage upwardly through the fluidized bed in the gasification zone. The fines in the off gases are converted by the gasification reaction in the gasification zone to form a part of the fuel gas and the ash. The fuel gas is withdrawn from the upper portion of the gasification zone and ash is withdrawn from the bottom of the gasification zone.

8 Claims, 1 Drawing Figure

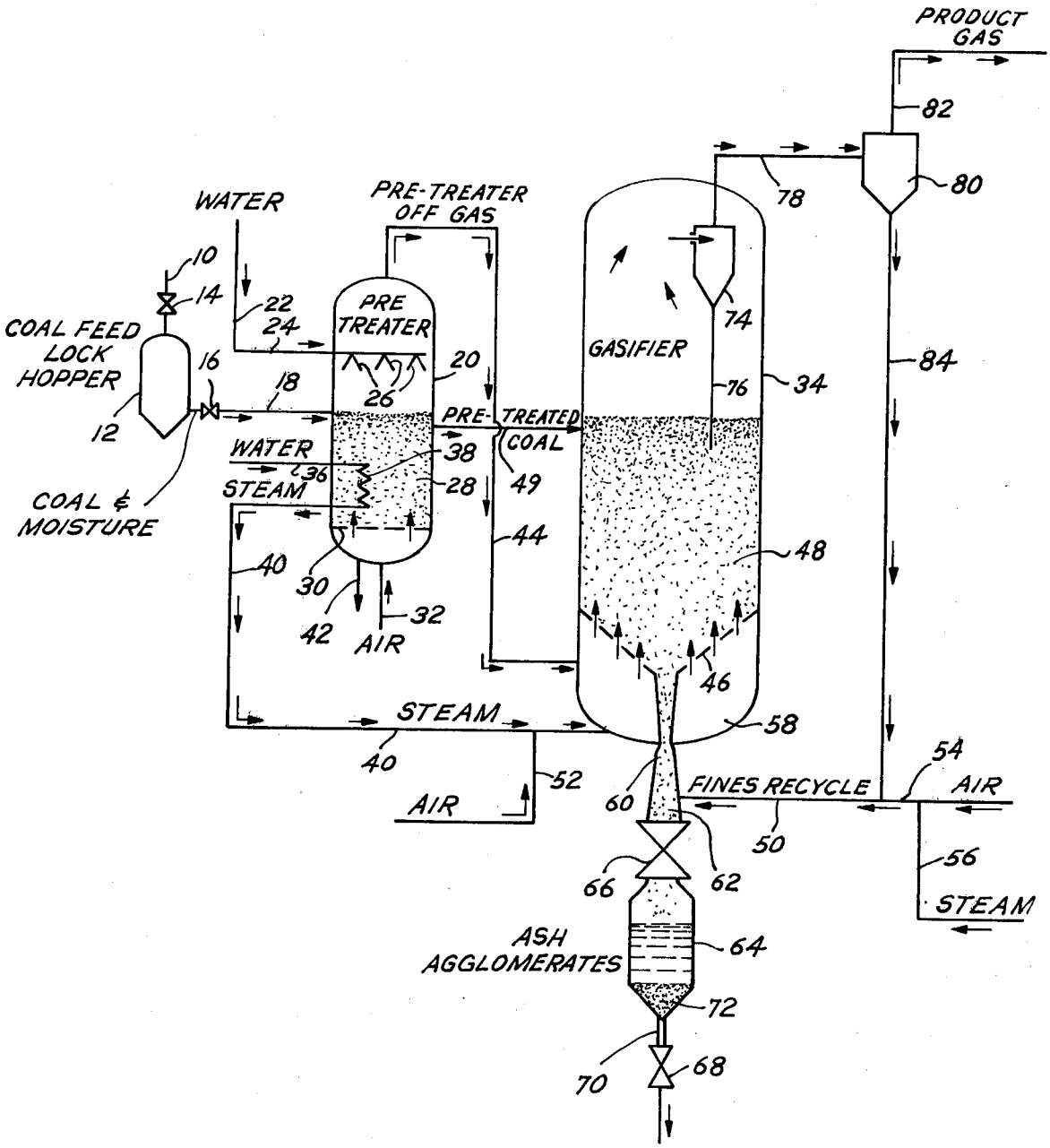
PRODUCT GAS
82
80
78
WATER
PRE-TREATER OFF GAS
10
14
22
24
PRE TREATER
20
26
COAL FEED LOCK HOPPER
16
18
12
GASIFIER
74
76
34
84
PRE-TREATED COAL
49
WATER
36
38
STEAM
28
COAL & MOISTURE
44
48
40
30
42
32
AIR
46
STEAM
58
40
52
AIR
60
FINES RECYCLE
54
AIR
50
56
66
62
STEAM
ASH AGGLOMERATES
64
72
70
68

COAL PRETREATMENT AND GASIFICATION PROCESS

BACKGROUND OF THE INVENTION

FIELD OF THE INVENTION AND DESCRIPTION OF THE PRIOR ART

This invention relates to a process for gasifying carbonaceous feed materials, particularly coal, and it particularly relates to a process for gasifying both caking and non-caking coals to produce a low or medium BTU fuel gas which is substantially free of condensible tars and oils.

One of the main sources of atmospheric pollutants today is from coal-fired electrical utility boilers. In these installations, a clean fossil fuel, such as natural gas, is not a practical substitute for coal in the generation of electricity because of scarcity and cost. Furthermore, the available supply of clean fuel may combat pollution more effectively when used to fulfill residential and small commercial needs.

As an example, combustion products of coal contribute approximately one-eighth of the total atmospheric pollutants emitted in the United States, including approximately one-half of the sulfur oxides and approximately one-quarter of both the nitrogen oxides andd of the particulates. Sulfur emissions from coal combustion may be reduced (a) by using low sulfur coal, (b) by cleaning high sulfur coal by physical methods, (c) by removing sulfur oxides from coal combustion gases, (d) by removing sulfur during the combustion step, (e) by producing de-ashed low sulfur fuel by the solvent processing of coal, and (f) by gasifying coal and removing sulfur from the gas before combustion.

The last procedure, gasification with gas cleaning before combustion, appears to offer the greatest reduction in sulfur emission since most of the sulfur and gasified coal appears as hydrogen sulfide. The removal of the hydrogen sulfide presents no great problem, however, since several different commercial gas cleaning processes are available today which can reduce the hydrogen sulfide content of gas streams from coal gasification to less than 10 PPM, and some processes remove hydrogen sulfide to 1 PPM or less.

Among the processes known for the conversion of coal to a fuel gas is that shown in Williams U.S. Pat. No. 2,805,189. In this process, coal is pretreated in a fluid bed prior to gasification at a temperature below about 600° F. The resultant off gases are not recovered and a special solids transfer line is provided to insure that these gases do not enter the gasification reactor. This procedure results in a loss of some valatile hydrocarbons, lowers overall process yield, and present an additional gas stream that must be purified before disposal.

In Howard U.S. Pat. No. 2,582,712, particulate coal is preheated at 900°–1400° F in admixture with a large volume of residue from a gasification reaction zone. Specifically, about 15–30 units of hot residue from the gasification reaction are admixed with a single unit of fresh feed coal to rapidly heat the fresh feed to a non-caking temperature. This process requires the circulation of large amounts of residue thereby increasing the cost of the unit and subjecting the unit to considerable wear due to the abrasive nature of the residue.

In the Kalbach U.S. Pat. No. 2,687,950, there is disclosed a process for gasifying materials such as coal, including anthracite, bituminous and lignite, to produce a gas rich in hydrogen and a fuel gas having a relatively high heating value. The coal is first introduced into a carbonization zone for direct contact with hot gases at a temperature range of 1000° to 1500° F. The carbonaceous residue is introduced to a gasification zone.

The Matthews U.S. Pat. No. 3,884,649, shows a process wherein caking coal is converted to a fuel gas by first pretreating the caking coal and then passing the pretreated coal to gasification zone. In the Matthews invention, the off gases formed in the pretreater are passed to the gasification zone. The present invention is considered an improvement over the invention shown in the Matthews patent.

SUMMARY OF THE INVENTION

It is therefore an object of the present invention to provide a process for gasifying coals, of both the caking and non-caking types, in order to produce a low or medium BTU fuel gas, free of condensible tars and oils, wherein the coal pretreatment step generates at least a portion and preferably all of the steam required for the gasification reaction.

It is also an object of the present invention to provide an improved process for producing a low or medium BTU fuel gas wherein the coal is pretreated and then the pretreated coal is gasified in a gasifier chamber, the off gases generated in the pretreater being passed directly to a fluidized bed of coal contained in the gasifier in order to provide steam for the gasification reaction, in order to destroy the oils and tars contained in the off gases, and in order to convert the fines in the off gases to a gas and ash.

It is yet another object of this invention to provide an improved process for coverting a caking coal to provide a fuel gas relatively free of oils and tars wherein the process is particularly characterized by its thermal efficiency as the steam generated in a pretreater provides all the steam required for the gasification reaction.

Further purposes and objects of this invention will appear as the specification proceeds.

The foregoing objects are accomplished by providing an improved process for converting a finely divided coal to a fuel gas, wherein the process includes the steps of pretreating a finely divided coal feed material for destroying the caking properties of a caking coal or for heating a non-caking coal feed, in a fluidized pretreatment zone, while forming hot off gases; the pretreatment zone communicates directly with a gasification zone and the pretreated coal is passed from the pretreatment zone to the gasification zone; the pretreated coal is maintained as a fluidized bed in the gasification zone at suitable conditions for converting the pretreated material to ash and a gaseous mixture; the gaseous mixture is passed to the upper portion of the gasification zone and ash is withdrawn from the bottom of the gasification zone; the improvement in the process includes passing the hot off gases from the pretreatment zone to the underside of the fluidized bed in the gasification zone and passing the off gases upwardly through the fluidized bed; the off gases generally include steam, tars, oils and carbonaceous fines; the steam in the off gases is used as at least a portion or, preferably, all of the steam required for the gasification reaction of the coal feed material in the fluidized bed in the gasification zone for converting the gaseous material to ash and the gaseous mixture. Also, the tars and oils contained in the off gases are substantially destroyed during passage through the fluidized bed in the gasification zone, and the coal fines are converted to a gaseous mixture and ash.

BRIEF DESCRIPTION OF THE DRAWING

Referring to the accompanying drawing, there is shown a preferred system useful for carrying out the improved coal gasification process.

DETAILED DESCRIPTION OF THE PREFERRED EMBODIMENTS

Referring to the drawing, coal is fed through the line 10 and into a coal feed lock hopper 12. The coal may either be caking or non-caking coal, including bituminous coal, anthracite coal, and lignite. However, the advantages of the invention are more fully utilized by providing a pulverized caking bituminous feed coal, such as Illinois or Ireland coal, having a particle size in the range of less than about ¼ inch to about ⅛ inch. When the lock hopper 12 is filled with a selected amount of coal, an inlet valve 14 in the inlet line 10 is closed. A hopper outlet valve 16 in a coal outlet line 18 is opened and the coal in the lock hopper 12 is passed through the line 18 to the pretreater chamber or zone 20. The lock hopper 12 is not needed when, in an alternate arrangement, water is added to the coal feed to form a coal-water slurry feed to the zone 20. Water may be added directly to the pretreater 20 through the line 24 and to spray heads 26 in the pretreater 20 for spraying water directly onto the surface of the fluidized bed of pulverized coal located within the pretreater 20 when a coal-water slurry is not fed to the pretreater 20.

The pulverized coal that is passed to the pretreatment zone 20 is maintained as a fluidized bed 28 therein above a grate or grid 30 located at the lower end of the pretreater 20. The bed 28 is maintained as a fluidized bed preferably by the addition of oxygen or an oxygen containing gas, such as air, which enters the bottom of the pretreater 20 through the line 32 for upward flow through the fluidized bed 28. Desirably, as when a caking coal is being treated, the oxygen content of the gas is adjusted to oxidize about 10% of the carbon value of the coal that is passed to the pretreatment zone 10. The oxidation serves to oxidize the surface of the coal and prevent the coal from agglomerating when passed to the higher temperature in the gasification zone or gasifier 34. Typically, about 1 to about 1.5 SCF of oxygen, as in an air stream, are used per pound of coal being passed to the pretreatment zone. The overall conditions within the pretreatment zone 20 then result in an oxygen deficiency and the off gases are substantially oxygen free.

The temperature within the pretreatment zone 20 is carefully controlled to be maintained between about 700°–800° F, preferably 750°–800° F. The temperature maintenance may be accomplished by passing cooling water through a line 36 and through a heat exchange coil 38 located within the fluidized moving bed 28 when caking coal is used. As will be discussed hereinafter, the heat exchanger 38 may be eliminated or may not be used depending on the type of coal feed and/or the amount of water being introduced to the pretreater 20. The heat generated in the fluidized bed by controlled combustion or oxidation of the coal converts water in the heat exchange coil 38 to steam, thereby efficiently removing heat from the pretreatment zone. The steam is removed through the line 40 passing from the heat exchange coil 38. The steam passing through the line 40 is passed to the bottom of the gasifier 34 where it is to be used in a manner to be hereinafter described in greater detail.

In addition to the dissipation of heat through the heat exchanger 38, the heat evolved during pretreatment of the coal in the pretreater 20 is removed by vaporizing the water that is sprayed on the top of the fluidized bed 28 from the spray heads 26, and/or by vaporizing water that is in the feed coal as bound moisture, and/or by vaporizing the water that enters the pretreater 20 as a coal-water slurry. There are a number of advantages in dissipating the heat evolved during the pretreatment process by this technique. By dissipating the heat in this manner, the heat transfer surface required for the heat exchanger 38 is substantially reduced or the heat exchanger may even be eliminated. By reducing or eliminating the heat transfer surface area, a smaller and less expensive pretreater vessel 20 may be utilized. Further, by dissipating heat in the described manner in the pretreater 20, the coal does not have to be dried before entering the pretreater 20. Still further, if a coal-water slurry is utilized in the feed, the use of the lock hopper 12 may be eliminated. Another advantage is that the water sprayed on the pretreater bed 28 from the spray heads 26 may be untreated water which may be generated and/or recycled in the process, thereby eliminating costly polluted water treatment facilities. Possible pollutants in the water include phenol, ammonia, tar and oils, all of which would be substantially destroyed in the pretreater 20. Also, as will be described hereinafter in greater detail, the off gases generated in the pretreater 20 include steam which is used in the gasification reaction in the gasifier 34, thereby reducing or even eliminating the need of an external, separate source of steam, such as a waste heat boiler or a direct fired boiler.

Materials, such as slate, gangue, rocks and the like, normally present in the feed coal, may be removed from the bottom of the pretreatment zone 20 so as to prevent the passage of this material to the gasification zone 34 where they might interfere with the system for removing agglomerated ash. The pulverized coal particles have a density which is significantly less than the higher density materials, gangue, rocks, slate and the like. As a result, the air entering the bottom of the pretreater 20 through the line 32 passes upwardly through suitable openings in the grate 30 and causes a selective separation of the lighter coal particles from the more dense gangue, slate and rock particles. These particles are selectively withdrawn from the pretreater vessel 20 through the line 42 for disposal.

The off gases from the pretreater 20 are passed from the top of the preheater 20 through the line 44 and these gases are introduced to the lower portion of the gasifier, either below a grid or grate 46 located at the bottom thereof, or directly into the fluidized bed 48 of pretreated coal within the gasifier 34. The pretreater off gases contain steam generated as a result of maintaining the desired temperature of 700°–800° F in the pretreater 20. Also, additional steam is generated in the pretreater as a result of the chemical reactions involved in the mild oxidation of coal with air therein. The use of the off gases in the described manner is considered important and this step will be hereinafter described in greater detail.

The top portion of the fluid bed 28 of coal in the pretreater 20 flows over and passes through a conduit 49 to the top portion of the fluidized bed 46 in the gasifier 34, so as to provide direct communication between the gasification zone 34 and the fluidized bed 28. Because of this direct communication between the gasifier 34 and the pretreater 20, the pressure in the pretreater and in the gasifier are the same, as from atmospheric pressure up to about 1000 PSIG. Be feeding the coal to the surface of the fluidized bed 48 in the gasifier 34, the formation of tars and oils is substantially avoided while taking advantage of any devolitalization of the gases and of any methane formation.

In the gasifier 34, the coal is reacted with steam and air entering the underside of the fluidized bed 48, either below the grid 46 through the conduit 40 or through a central portion 60 through a line 50. The coal in the fluid bed 48 is converted, by known reactions with air and steam, to typically produce a mixture of hydrogen, carbon monoxide, methane, and nitrogen, if air is used rather than pure oxygen in the lines 40 and 50. The air or oxygen needed for the gasification reaction is passed from an external source through a line 52 to the steam line 40 to the bottom of the gasifier 40 below the grid 46. Additional air, if needed, is passed through the line 54 to the line 50.

The steam used for the process selectively comes from three different sources. The first and primary source of the steam required for the reaction in the gasifier 34 is from the pretreater off gases passing through the line 44 to the bottom of the gasifier 34 to the bed, either below the grid 46 and below the fluidized bed 48 or above the grid 46 and directly into the fluidized bed 48. If the heat exchanger 38 is used in the pretreater 20, the steam generated therein is passed to the underside of the grid 46 through the line 40, thereby defining a second steam source. Finally, an external source of steam may be added to the line 40 through the line 56, as a third steam source.

The air and steam are added to the generally annular space 58 below the grid 46 in the gasifier 34 to maintain the fluid bed 48 in constant suspension, motion and circulation. The fluid bed 48 is maintained at a temperature of above about 1500° F and preferably at about 1700°–1900° F. The temperature is maintained below the softening temperature of the ash in the coal. The exact temperature in the gasifier 34 is a function of the specific coal being processed in the gasification zone 34 and is readily determined without undue experimentation by those skilled in the art.

The bottom section of the gasification zone 34 is maintained at a temperature above or close to the softening temperature of the ash and comprises an inverted conical shaped grate or grid 46 which is sloped downwardly towards the central venturi section 60. The bottom grid construction is designed as taught by the Jequier U.S. Pat. No. 2,906,608 or Matthews U.S. Pat. No. 3,884,649, and also as taught in the Matthews and Patel U.S. Pat. No. 3,935,825. The grid 46 defines an inverted cone below the bed 48 in the gasification zone 34. The temperature at the lower part 62 of the venturi 60 is maintained at a temperature greater than the temperature of higher sections of the fluid bed 48 by the introduction of a richer air-steam mixture passing therein through the line 50 and the temperature is in a range at which the coal ash becomes sticky. These higher temperatures, that is 50°–200° F higher than the bed proper, cause the ash particles to stick together and agglomerates are formed which can be withdrawn when they reach a predetermined size in the lower section 62 of the venturi section 60. The agglomerates are then passed to a lock hopper 64 through a central valve 66.

The ash agglomerates are removed from the lock hopper 64 by opening an outlet valve 68 in an outlet line 70. The velocity of air and steam entering the throat of the venturi 60 at the base of the conical grid 46 controls the size of the ash agglomerates and has a velocity of about 40 feet/second to about 200 feet/second. The hot agglomerated ash particles are quenched in the lock hopper 64 by cooling water which is passed therethrough. The ash settles as a layer 72, near the bottom of the lock hopper 64 and is periodically discharged therefrom by closing the valve 66, thereby isolating the lock hopper from the gasifier 32, and then opening the outlet valve 68 and the water-ash mixture is discharged as a slurry through the conduit 70.

The pretreater off gas passing through the line 44 to the annular space 58 or into the fluidized bed, in addition to containing the steam generated as a result for maintaining the desired temperature of about 750°–800° F in the pretreater 20, also contains steam generated as a result of the chemical reactions involved in the mild oxidation of coal with air.

The pretreater off gases further contain a substantial quantity of tars, oils and coal fines. As much as 20% to 30% of the coal weight loss in the pretreatment zone 20 is due to these tars, oils and fines. The pretreater off gases only have a heating value of about 10–40 BTU/SCF. These gases have much too low of a heating value to be usefully burned in a boiler or be otherwise utilized. Normally, gases with such a low heating value would be disposed of by venting to the atmosphere. However, such gases normally have to be purified and cooled in a fairly elaborate system before being released to the atmosphere. By introducing the pretreater off gases through the line 44 to the annular chamber 58 in the bottom of the gasifier 34, a number of advantages result. First, the overall thermal efficiency of the process is increased by retaining the pretreater off gas energy content within the process and any tars and oils present are destroyed because of the high operating temperatures of up to 1900° F in the gasifier 34. Even more important, the steam formed in the pretreater 20 and passed off with the pretreater off gases is utilized for the coal gasification reactions and thereby minimizes or eliminates the need for external steam requirements for a given coal feed rate. Preferably, the steam generated within the pretreater and carried with the pretreater off gases to the bottom of the gasifier 34 acts as the sole source of steam needed for the gasification reaction in the gasifier 34.

The gases produced in the fluidized bed 48 generally comprise a mixture of fuel gases, such as a mixture of hydrogen, carbon monoxide, carbon dioxide and methane. If air is used rather than pure oxygen either in the pretreater 20 or in the gasifier 34 nitrogen is also present in the produced gas.

The product fuel gas, containing solids, is passed to a cyclone 74 located within the gasifier 34 at the upper portion thereof. The larger solid materials are separated and passed down through the conduit 76 and back to the fluidized bed 48 for conversion of any carbon therein.

The remaining gas, carrying very fine particulate matter, is passed from the cyclone 74 upwardly through an outlet line 78 and to an external cyclone 80. In the external cyclone 80, the raw product gas is recovered and passed outwardly therefrom through the line 82 for further treating by methods well known to those skilled in the art. As an example, the product gas stream passing through the line 82, after suitable heat recovery and pressure reduction, may be passed to a Stretford unit for removal of any sulfur contained in the gas to thereby produce a relatively pollution free gas. The fines are removed from the external cyclone 80 through the line 84 and are passed downwardly to the line 50 which may also include air and/or steam. The solids may be admixed with the air-steam mixture in the line 50 and the resultant mixture is directed to the section 62 below the venturi 60, wherein the carbon present in the fine particles is gasified and the very fine dust agglomerates with the ash for withdrawal from the system. The coal dust is introduced to the section 60 at a velocity of about 50–200 feet/second, preferably at a velocity of about 60–80 feet/second. Preferably, the end of the line 50 is bent upwardly so that the coal dust is moving in a vertical direction as it enters the section 62 and does not fall downwardly along with the ash agglomerates.

As mentioned previously, our process may be used in connection with both caking and non-caking coals. Certain non-caking coals, such as lignite and some subbituminous coals, do not require treatment to destroy their caking tendencies before being fed to the gasifier vessel 20. With these types of coals, the process may be used with only minor changes. The pretreater vessel 20 is then used basically as a coal drying vessel. The non-caking coals which normally contain higher amounts of bound moisture are dried by either using hot gases from a source in the process or by a milder particle surface oxidation with air. Also, the steam coils 38 in the fluidized bed 28 are not required. The steam generated by drying the coal as received is fed to the bottom of the gasifier 34 in the manner as described above to provide the same results and benefits as in the case of caking coal.

The process may be used with certain variations. The steam coil 38 in the fluidized bed of the pretreater 28 may be used to remove some of the heat of the oxidation reaction and the remainder of the heat may be used in drying the coal feed to the pretreater 20. Also, in addition to drying wet coal, water may be sprayed through the spray heads 28 into the preheater 20 so as to generate sufficient steam to satisfy all the steam requirements for the reactions in the gasifier 34. When used in this manner, only air is supplied to the gasifier 34. Typically, the gasifier 20 requires about 0.5 pounds of steam per pound of coal for the desired gasification reaction. The pretreater 20 releases about 400–800 BTUs per pound of coal being pretreated. In such a case, if the pretreater operates at about 300 PSIG and 800° F, about 80% of the heat release is utilized to generate steam for the gasification reaction and about 20% of the heat is removed by steam coils.

The steam coils 38 may be turned off or may be totally eliminated if a coal-water slurry is fed to the preheater 20. The water present in the slurry is controlled so as to dissipate all the heat released by the pretreatment process. As the pretreater 20 releases about 600–800 BTUs per/pound coal being pretreated, at about 300 PSIG at about 800° F, a coal-water slurry of about 55 - 60% by weight of coal would utilize all the evolved heat when the slurry is preheated to about 200° F.

While in the foregoing there has been provided a detailed description of particular embodiments of the present invention, it is to be understood that all equivalents obvious to those having skill in the art are to be included within the scope of the invention as claimed.

What we claim and desire to secure by Letters Patent is:

1. In a process for the conversion of finely divided caking coal to a fuel gas wherein said process includes the steps of pretreating a finely divided coal feed material at a temperature of about 700°-800° F in a fluidized pretreatment zone while forming hot off gases, said pretreatment zone being in direct communication with a gasification zone, passing the pretreated coal from said pretreatment zone to said gasification zone, maintaining said pretreated coal as a fluidized bed in said gasification bed in said gasification zone at preselected conditions for converting said pretreated coal to ash and a gaseous mixture comprising fuel gas, with drawing said gas from said gasification zone, and withdrawing said ash from said gasification zone, an improvement in said process comprising the steps of adding water directly into said pretreatment zone to dissipate heat generated therein and to generate steam, passing said hot off gases from said pretreatment zone to below the upper surface of said fluidized coal bed in said gasification zone, said off gases comprising said steam, tars, oils and coal fines, passing said off gases upwardly through said fluidized bed, reacting said steam with said coal in said fluidized bed for converting said coal to said ash and said gaseous mixture, said off gases heating said gasification zone for assisting in maintaining said preselected conditions in said gasification zone, substantially destroying said tars and oils during passage through said fluidized bed in said gasification zone, and converting said fines in said off gases to a portion of said gaseous mixture and a portion of said ash.

2. The improved process of claim 1 wherein said pretreating step is at a temperature of 750°- 800° F and at a pressure of up to about 1000 PSIG.

3. The improved process of claim 1 wherein said steam in said off gases provides the sole source of steam for said gasification reaction in said gasification zone.

4. The improved process of claim 1 wherein water is vaporized by indirect heat exchange in said bed in said pretreatment zone to form steam, and including the step of passing said steam to said gasification zone.

5. The improved process of claim 1 wherein said water is added is part of a slurry of said coal and water to said pretreatment zone.

6. The improved process of claim 1 wherein said water is sprayed directly into the interior of said pretreatment zone.

7. The improved process of claim 1 wherein air is also added to said gasification zone for reaction with said steam and said coal to form said ash and said gaseous mixture.

8. The improved process of claim 1 wherein said temperature in said gasification zone is about 1700°–1900° F and the pressure is up to 1000° PSIG.

* * * * *